US005934992A

United States Patent [19]

Sohier et al.

[11] Patent Number: 5,934,992

[45] Date of Patent: Aug. 10, 1999

[54] CONFINEMENT METHOD AND DEVICE IN PARTICULAR FOR A SPECIAL ATMOSPHERE IN A SPACE FOR CONTINUOUSLY PROCESSING ARTICLES FED THERETHROUGH

[75] Inventors: Laurent Sohier; François Meline, both of Paris, France

[73] Assignee: Societe Generale Pour Les Techniques Nouvelles Sgn., Montigny-Le-Bretonneux, France

[21] Appl. No.: 08/875,684

[22] PCT Filed: Feb. 1, 1996

[86] PCT No.: PCT/FR96/00170

§ 371 Date: Aug. 1, 1997

§ 102(e) Date: Aug. 1, 1997

[87] PCT Pub. No.: WO96/24011

PCT Pub. Date: Aug. 8, 1996

[30] Foreign Application Priority Data

Feb. 2, 1995 [FR] France ..... 95 01211

[51] Int. Cl.[6] ..... F24F 9/00

[52] U.S. Cl. ..... 454/190; 454/191

[58] Field of Search ..... 454/187, 188, 454/190, 192, 191

[56] References Cited

U.S. PATENT DOCUMENTS

| | | | |
|---|---|---|---|
| 4,576,613 | 3/1986 | Miline | 55/1 |
| 5,145,459 | 9/1992 | Meline et al. | 454/190 |
| 5,312,294 | 5/1994 | Meline | 454/60 |
| 5,336,085 | 9/1994 | Sharma et al. | 432/64 |

*Primary Examiner*—Harold Joyce
*Assistant Examiner*—Derek S. Boles
*Attorney, Agent, or Firm*—Cohen, Pontani, Lieberman & Pavane

[57] ABSTRACT

The present invention relates to a method for confining an atmosphere (B) in a space (4) communicating with its surroundings via at least one opening. A gas curtain (1+2) comprising a low-velocity jet (2) and a high-velocity jet (1) is generated at said opening. Characteristically, a fraction of the flow in said low-velocity jet (2) is injected into the confined atmosphere (B) and adds to the induced flowrate of said low-velocity jet (2), the size of said fraction being variable depending on the pressure within said space (4). The present invention also relates to a device for carrying out said method.

13 Claims, 1 Drawing Sheet

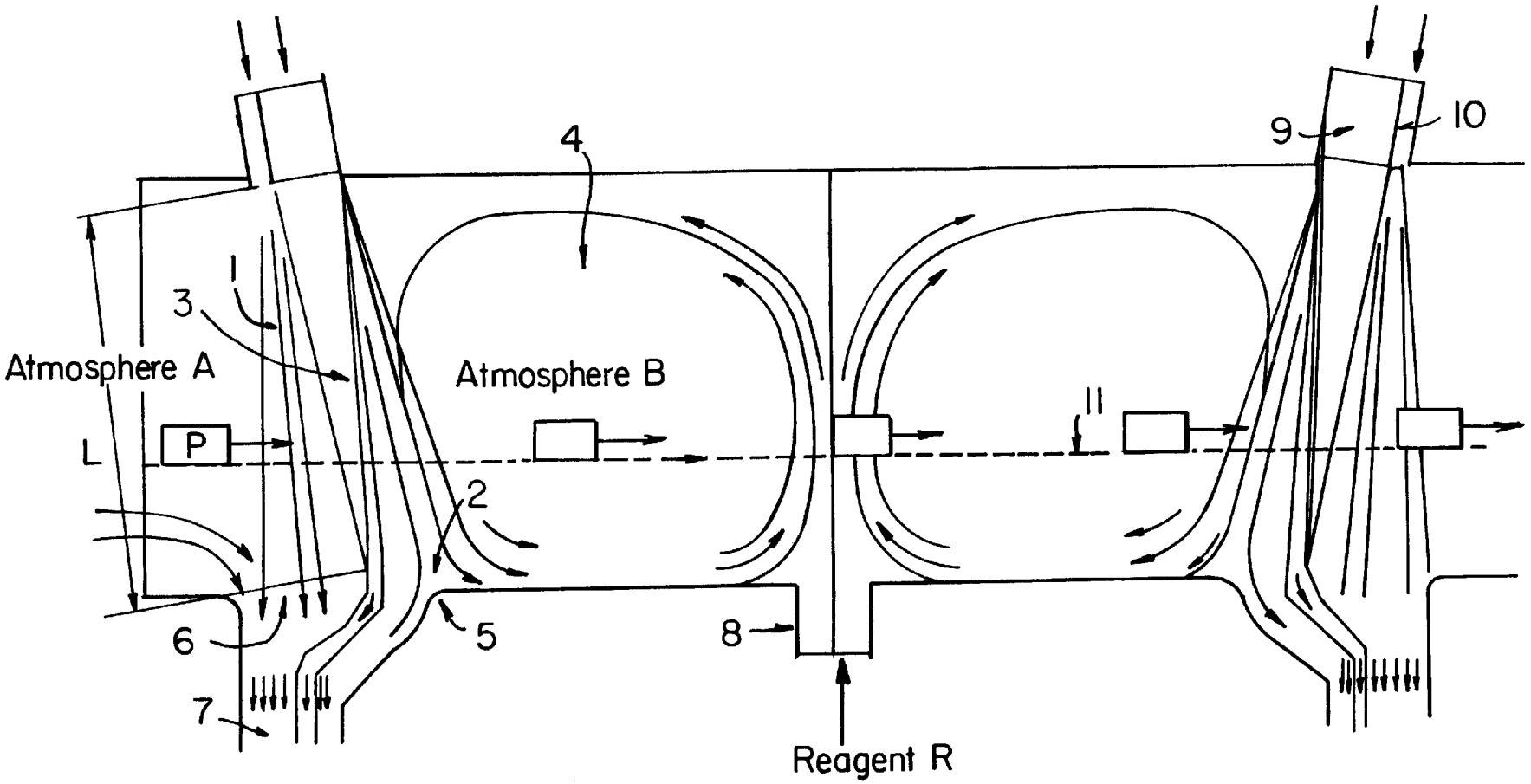
10
9
11
Reagent R
8
4
Atmosphere B
2
5
1
3
P
6
7
Atmosphere A
L

CONFINEMENT METHOD AND DEVICE IN PARTICULAR FOR A SPECIAL ATMOSPHERE IN A SPACE FOR CONTINUOUSLY PROCESSING ARTICLES FED THERETHROUGH

The present invention has for its object a method and a device for confinement of an atmosphere in a space communicating with the outside thanks to at least one opening; a gas curtain being generated at the level of said opening.

This method and device are advantageously employed for the confinement of a special atmosphere in a space for continuously processing objects or articles fed therethrough. According to the prior art, to Applicants' knowledge, particularly when such processing employs explosive, toxic and/or contaminating substances, they are employed discontinuously. Thus, when it is desired to process articles in an atmosphere presenting particular characteristics which must be maintained between precise values (characteristics of temperature, hygrometry, gaseous composition, concentration of liquid or solid particles in suspension . . . ), one generally proceeds in spaces provided at the entrance and at the exit with chambers with tight double doors. Under such conditions:

processing can be effected only by successive batches;

the quantity of articles processed depends on the volume of the chambers;

the successive filling and emptying of the chambers bring about a loss of matter and energy, proportional to the volume of said chambers . . .

According to the present invention, an improvement to the conventional technology of the confinement of a space by a double-jet gas curtain is proposed more precisely. Said technology is illustrated in particular in Patent Applications FR-A-2 530 163 (confinement of a polluted space) and FR-A-2 652 520 (confinement of a "clean" space). According to the said technology, the double-jet gas curtains are used for separating two spaces containing atmospheres of different characteristics. Such gas curtains are intended to stop any solid or liquid particles in suspension in the atmospheres of the separated spaces but must, however, allow the passage of macroscopic objects passing therethrough without exchange between said separate atmospheres.

Such gas curtains comprise a slow jet of which the point (the inner cone: potential flowing zone) ensures the dynamic separation of the atmospheres and a fast jet which stabilizes and rigidifies said slow jet.

Incidentally, it is recalled here that the flow of a jet of gas, in any section thereof, is generally the sum of the initial flow of gas blown in and of the flow taken by suction in the gaseous environment outside the jet. This second flow constitutes the induced flowrate of said jet.

Opposite the jet emission nozzles, there is generally found a suction orifice which collects the gas blown as well as a fraction of the separate atmospheres which are mixed with said blown gas in the induction zone. The gases collected by such a suction orifice are generally processed before recycling or rejection in the environment. The matter and energy lost by the suction flow are considered as necessary and/or negligible vis-a-vis the result sought. However, the suction orifice does not systematically take up the double jet. The nozzles for emission of the fast jet and of the slow jet are supplied with non-polluted gas. They generally present a slight inclination, towards the outside of the opening of the space to be confined, such that in the hypothesis of confinement of a "clean" zone to be protected from the outside pollution (context of document FR-A-2 652 520)—that face of the fast jet located towards the space to be confined is virtually parallel to the plane of said opening. Said "clean" space to be confined is supplied by a flow of non-polluted gas, called clean gas stream, slightly greater than the flowrate induced by the inner face of said fast jet (located towards the space to be confined); the excess flowrate with respect to the latter ensuring a slight leakage rate which prevents the penetration of the fast jet in said space to be confined. In any case, according to the prior art, the nozzles of the gas curtain never inject gas directly in the space to be confined.

Conventionally, when it is question of protecting an environment from "pollution" (the "pollution" being located inside or outside the space to be confined), the fast jet is always located towards the non-"polluted" side.

The double-jet gas curtain is generally a curtain of air. The air injected in the form of slow and fast jets is returned into circulation or rejected, after filtration of the particles in suspension entrained in the suction orifice.

According to its first object, the invention therefore relates to a method for maintaining a particular atmosphere in a space communicating with the outside thanks to at least one opening protected by a double-jet gas curtain. Said atmosphere is special in that it is distinguished from the ambient atmosphere by at least one differentiating element which, for example, may consist of a concentration of particles, a concentration of gas, a temperature, . . . Said special atmosphere or differentiated atmosphere is therefore confined in said space. According to the context, said special atmosphere is a clean atmosphere or a polluted atmosphere with respect to the ambient atmosphere. The slow jet of the gas curtain is disposed towards said confined atmosphere in order to avoid the turbulent transfers due to the passages of the objects passing therethrough. The axial plane of the emission nozzle of the slow jet and that of the emission nozzle of the fast jet are parallel. Said nozzles may be disposed on any one of the sides of the opening.

More precisely, the method of the invention is a method for confinement of an atmosphere in a space communicating with the outside thanks to at least one opening; method in which:

a) a curtain of gas is generated at the level of said opening; said gas curtain comprising:

a first jet, called slow jet, located towards said confined atmosphere; said slow jet presenting a point of range (L) and spread sufficient to cover said opening;

a second jet, called fast jet, located towards the outside, in the same direction as said slow jet, of which the axial plane is parallel to that of said slow jet; said fast jet having a flowrate induced by its inner face in contact with the slow jet less than or equal to the flowrate of said slow jet at a distance (L), equal to the range of said slow jet, from its injection;

b) at least a part of the gas blown in in the form of said slow and fast jets as well as a fraction of the confined atmosphere are taken up, at the level of said opening, opposite the injection zone of said jets;

c) a supply of said space with adequate atmosphere is advantageously provided, in order at least to compensate said fraction of the confined atmosphere taken up;

d) a fraction of the flow of the slow jet is injected in said confined atmosphere and contributes to the induced flowrate of said slow jet; the size of said fraction varying with the pressure within said space.

According to the method of the invention, a double-jet gas curtain is therefore employed, the slow jet of said curtain being located towards the special confined atmosphere (point a) hereinabove) and, opposite the injection zone of the jets, a device, including a suction orifice for taking up the gas blown in in the form of said jets and a fraction of said confined atmosphere (point b) hereinabove). A fraction of the ambient atmosphere is also generally taken up, at the level of said suction orifice. Said jets and said suction orifice are disposed so as to maintain in the confined atmosphere characteristics which are constant or included between precise values. As will be explained hereinafter, their particular arrangement makes it possible to minimize the losses of matter and/or energy by the take-up flowrate and consequently to minimize the continuous additions necessary for maintaining said particular characteristics of the confined atmosphere. In fact, insofar as it is desired to ensure such maintenance, an adequate supply of said space is provided, at least to compensate the fraction of the confined atmosphere taken up point c) hereinabove) and advantageously to contribute to maintaining the confined space in slight overpressure. Said space is thus efficiently protected from the ambient atmosphere.

However, the man skilled in the art will understand that the method of the invention may also be carried out without such a supply point c) hereinabove), insofar as the take-up of the confined atmosphere is, according to the invention, minimized and in any case is compensated by blown in gas taken from the zone of induction of the slow jet. However, such conditions of implementation (without supply) which are not excluded from the scope of the present invention, do not ensure an optimum result. Under these conditions, the confined atmosphere will lose its characteristics of differentiation after a more or less long period. This may be considerably detrimental in the context of a continuous processing of traversing products by a reagent present in said confined atmosphere . . . It is much less so, for example, in a context where it is desired simply to maintain said confined atmosphere at a given temperature and where the slow jet supplies gas at said temperature . . . As indicated hereinabove, according to an advantageous variant of the method of the invention, a supply of adequate atmosphere of the confined space is therefore provided.

Finally, and here it is question of the principal characteristic of the method of the invention, a fraction of the flow of the slow jet is sent into said confined atmosphere (point d) hereinabove). Said fraction is taken in the induction zone of the slow jet, on the confined space side, of course. It is not directly taken up by the suction orifice. It penetrates in said confined atmosphere, generates turbulences therein and is at least partly taken up by the slow jet for induction thereof. In this way, the induced flowrate of the slow jet is, characteristically according to the invention, taken partly on itself (towards the confined space). Towards the confined space, said slow jet is self-stabilized. In fact, a part of it is "recycled" in the confined space to that end. On the ambient atmosphere side, it is recalled here that said slow jet is stabilized by the fast jet.

This gas injected in the confined atmosphere, taken on the slow jet, is used:

for homogenizing said confined atmosphere, for creating a certain overpressure within it, for regularizing the take-up of said injected gas and said confined atmosphere.

The method of confinement with double-jet gas curtain is in fact carried out according to the invention under conditions such that an effect of regularization of the extracted flow of confined atmosphere is observed, with maintenance of homogeneous conditions in said confined atmosphere. This effect of regularization is particularly interesting when the gas curtain defines a processing chamber in which a specific reagent must be maintained in sufficient concentration in the atmosphere for the duration of the processing. In fact, the incurvation of the curtain provoked by the overpressure (due pricipally to the injection in the confined space of a fraction of the flow of the slow jet) allows escape only of a weakly concentrated fraction of said specific reagent of the mixture between the gas blown by the slow jet and the processing atmosphere (said processing atmosphere having been diluted by the addition of "pure" gas of the slow jet) and therefore brings about only a negligible consumption of said reagent. Moreover, as indicated hereinabove, the turbulence generated inside the processing chamber (by injection of a fraction of the flow of the slow jet within it) homogenizes the distribution of said reagent in the atmosphere of the chamber, reagent advantageously continuously added in said chamber to compensate the losses.

Furthermore, it will be insisted upon, according to the method of the invention, that the gas curtain is not stiff, stabilized in a fixed position. Under the effect of a variation in pressure within the confined atmosphere (which pressure variation may be due to a variation in the adequate atmosphere supply flowrate and/or to the arrival of an object of large volume in the confined space), the jets move and a more or less large fraction of the flow of the slow jet is sent into the confined atmosphere.

According to the invention, the technology of the double-jet gas curtain has been adapted so as to minimize the losses of matter and/or energy coming from the confined atmosphere, via the suction orifice, while homogenizing the characteristics of said confined atmosphere.

The man skilled in the art will already have understood that the principle of the method of confinement according to the invention, as set forth hereinabove—with injection of a fraction of the flow of the slow jet in the confined atmosphere, which allows a regulation of the flow of said sucked confined atmosphere (while, according to the prior art, no regulation is observed of said flow of confined atmosphere extracted)—may be carried out in accordance with different configurations, and this in different contexts, particularly at the entrance and/or exit of painting tunnels, sterilization tunnels, processing ovens, drying ovens, . . .

A thermal confinement of the space may simply be sought, the other characteristics of the separate atmospheres being identical. The gas curtain will in this context be generated from the same atmosphere with at least one thermostated slow jet which will maintain the temperature in the confined space. By way of example, the production of cold or hot tunnels on object-conveying elements may be cited. The method of the invention makes it possible, in this context, for the objects to circulate continuously, limiting the losses of energy and the temperature gradients at the level of the inlets and exits of said tunnels.

The method of the invention may also be employed for packing possibly toxic and/or dangerous pulverulent products, and for the advantageously continuous processing of different types of products. By way of example of such processing, the smoking of agri-food products or the sterilization of objects by spraying liquid and/or gaseous disinfectants in the pharmaceutical industries may be cited.

Particular emphasis will be made on the advantage of carrying out the method of the invention for the confinement of a space for continuously processing products or objects passing therethrough, advantageously integrated in a line for conveying said products or objects. Such a processing space comprises a gas curtain at the inlet and a gas curtain at the exit; gas curtains which are generally flat, through which the objects or products to be processed, transported by the coveyor system, successively pass. If the spaces upstream and downstream of the processing space are at the same pressure, the two gas curtains function symmetrically and the same effect of regulation of the suction flowrate of confined atmosphere is obtained on said two curtains.

The method of the invention may be implemented in accordance with different variants. Advantageously, the expected result is obtained with a plane of the gas curtain which is inclined with respect to the plane of the opening, towards the interior of the confined space. Said gas curtain plane makes an angle with said opening plane, with the result that the end of the point of the slow jet is oriented towards the interior of the confined space. Said angle of inclination of the median planes of the gas jets with respect to the plane of the opening generally remains less than or equal to 30°. For certain applications, it advantageously makes it possible to increase the pressure in the confined space with respect to the outside pressure. Such increase in pressure (which generally remains of the order of a pascal) is due to the transformation of the dynamic pressure of the recycled fraction of gas into static pressure. It is a function of the value of said angle of inclination and of the shape of the suction orifice.

The or each gas curtain employed in the method of the invention may present varied geometries. It may be question of gas curtains generated by linear, polygonal or arcuate nozzles. The plane of the gas curtain will consequently describe, possibly with the above-mentioned inclination, either a plane or a portion of polyhedron, or a truncated surface portion. The geometry of the gas curtain is obviously adapted to that of the opening to be covered or to that of the confined space.

The gas curtain constituted by the two jets is generally generated from nozzles which may be located on a horizontal or vertical side of the opening giving access to the confined space.

Furthermore, as indicated hereinabove, according to a variant of the invention, at least one of the jets of said gas curtain, generally the slow jet (and advantageously the slow jet and the fast jet) is supplied with thermostatted gas. The gas supplying said slow and fast jets may generally present the same characteristics (for example: nature of said gases, temperature thereof, . . . ) or different characteristics.

Finally, it is specified that the gas curtain (or gas curtains) as employed in the method of the invention—gas curtain(s) with regulation of take-up flowrate—generally consist(s) of a curtain with double air jet. However, for certain applications, it is not excluded that the air be replaced by any other appropriate gas, particularly an inert gas in one jet only or the two jets. Neither, as indicated hereinabove, is it excluded that the injected gases, of the same nature or of different nature, may present different characteristics, particularly of temperature, hygrometry, concentration of liquid or solid particles in suspension.

In accordance with its second object, the invention relates to a device useful for carrying out the method described hereinabove. Said device comprises the conventional means necessary for generating and operating a double-jet gas curtain at the level of an opening. In characteristic manner, within said device, said means are arranged to ensure the expected effect described hereinabove, i.e. the injection of a fraction of the flowrate of the slow jet, for auto-induction thereof, in the confined space.

More precisely, said device comprises:

two nozzles disposed side by side on one side of said opening and provided with means for supplying gas thereto; the length of said nozzles being at least equal to the length of said opening, the width of said nozzles being determined as a function of the velocity of the jets and the range of the curtain to be obtained; the nozzle located towards the confined atmosphere being suitable for the emission of the slow jet and the other for the emission of the fast jet;

an orifice for suction of at least a part of the gas blown in in the form of jets and of a fraction of the confined atmosphere, said suction orifice being connected to a suction system and being located at the level of said opening, opposite said two nozzles;

advantageously a system for supplying the confined space with adequate atmosphere.

Characteristically, said gas suction orifice is positioned with respect to said two nozzles so that, and presents a geometry such that a fraction of the flow of the slow jet is injected in said confined atmosphere and contributes to the induced flowrate of said slow jet; the size of said fraction varying with the pressure within said confined space.

It will be noted that, at the level of said suction orifice, ambient atmosphere is in general also sucked.

Within said device, the two injection nozzles are advantageously oriented so that the plane of the gas curtain is inclined, with respect to the plane of the opening, towards the interior of the confined space. The angle of inclination as indicated above is included between 0 and 30°.

The position and geometry of the suction orifice must allow normal operation of the gas curtain as from starting and creation of a slight overpressure in the confined zone.

The gas suction orifice is disposed opposite, generally plumb with the gas supply of the curtain. In fact, it comprises a cavity for receiving gases which communicates with a conduit for evacuation thereof. Said cavity is advantageously connected to at least one of the material walls which define the opening.

In the more general context of the vertical or substantially vertical gas curtain, supplied with gas blown from top to bottom, the gas receiving cavity is advantageously connected to the base, to the floor of the confined zone.

In this context, the nozzles are disposed in the upper part of the opening and said cavity is located below the level of the base of the confined zone (floor of said zone). It is advantageously defined, on the slow jet side, by an edge with concave curvilinear profile, connected to said base of the confined zone. Said edge does not present an edge capable of generating turbulences. Its profile is concave, with the result that it "accompanies" the deformation of the end of the point under the effect of the overpressure.

The position and geometry of said cavity must allow normal operation of the gas curtain, in the absence of consequent overpressure in the confined zone. In this context of normal operation, the thinned end of the point of the slow jet arrives at the limit of the curvilinear edge of the cavity. Under the effect of a consequent overpressure, said end will deform and clear along said curvilinear edge a passage for the confined atmosphere (atmosphere in fact diluted in gas taken from the slow jet).

The device of the invention and its functioning will be described more precisely with reference to the single accompanying FIGURE hereinafter in the present text.

According to a variant of said device of the invention, the confined space is defined by a ceiling, a floor and at least two lateral walls. There may be three lateral walls and one sole opening to be covered by a gas curtain or only two parallel lateral walls and two openings to be covered by two parallel gas curtains. The injection nozzles of the gas curtain(s) are generally located at the level of the ceiling of the opening(s), the gas curtain(s) is/are substantially vertical and the suction orifice is integrated in the floor. The cavity for reception of the gases associated with said suction orifice is located beneath the level of said floor and is defined in width by the walls of the confined space.

According to another variant of the device of the invention, the confined space is defined by a circular ceiling, a circular floor and a cylindrical or truncated gas curtain. In this configuration of the device of the invention, the cavity of the suction orifice, opposite the circular gas injection nozzles, constitutes a pit around said base.

According to another variant of the device of the invention, the confined space is defined by a polygonal ceiling, a polygonal floor and a polyhedral gas curtain. In this configuration of the device of the invention, the cavity of the suction orifice, opposite the polygonal gas injection nozzles, constitutes a pit around said base.

The method and device of the invention are illustrated in accompanying FIG. 1.

Said FIG. 1 shows in section the confinement according to the invention of atmosphere B in a chamber 4 for continuously processing a product P, by a reagent R injected via tube 8. The product P is conveyed by the conveying system 11. The chamber 4 is defined by a horizontal ceiling, a horizontal floor, two vertical walls (not shown) and two plane vertical air curtains. The products P to be processed arrive from atmosphere A (ambient atmosphere, for example), pass successively through the inlet air curtain and the exit air curtain and are found again in said atmosphere A. Each of said air curtains comprises a slow jet 2, located towards the chamber 4, of which the point 3 is inclined towards the interior of said chamber 4 as well as a fast jet 1, locateds towards the outside (atmosphere A). The system for suction of the blown-in gas and a fraction of the confined atmosphere B is disposed plumb with the injection nozzles 9 and 10. Said suction system comprises the cavity 6 for receiving the gases and the conduit 7 for evacuation of said sucked gases. Said cavity 6 is defined towards the slow jet 2 by an edge 5 of concave curvilinear profile which joins the floor of the chamber 4.

The cavity 6 for receiving the gases has a geometry and a positioning with respect to the nozzles 9 and 10 such that, in stationary regime and in the absence of disturbance, the point 3 of the slow jet 2 is in the position of equilibrium, between the atmospheres A and B, shown in solid lines in FIG. 1. The flow of gas entrained by the slow jet 9 in its cross section located at the distance L from its origin is divided on the curvilinear edge 5 of the cavity 6 constituting the orifice for take-up of the double jet 1+2.

The major fraction of the flow of gas of the fast jet 1 and slow jet 2 is sucked by the take-up orifice 6 and evacuated via conduit 7. A fraction of this flow is injected in the confined space 4, inducing a stream which promotes homogenization of the atmosphere B. This "recycled" fraction is added to the light flow of reagent R introduced at 8 to ensure the induced flow rate at the interface between the slow jet 2 and the atmosphere B. The product of the average concentration in the fraction of atmosphere B extracted by its flowrate then corresponds to the addition of reagent R in the enclosure 4 via conduit 8.

If a disturbance increases the flow of reagent R introduced at 8, the resulting increase in pressure in the enclosure 4 has for its effect to incurve both of the two jets and to displace the point 3 of the slow jet 2 in the position shown in dotted lines in FIG. 1. This displacement brings about a reduction of the fraction of the flow of the slow jet 2 injected in the enclosure 4 associated with an increase in the flow of atmosphere B extracted. Furthermore, the average concentration of reagent R of said flow of atmosphere B extracted is all the higher as this flow is greater.

Symmetrically, if the flowrate of reagent R incidentally decreases, the reverse phenomenon occurs. The point 3 of the slow jet 2 moves towards the interior of the enclosure 4. This displacement brings about an increase in the fraction of the flow of the slow jet 2 injected in the enclosure 4 associated with a decrease in the flow of atmosphere B extracted. In the same way, the average concentration of reagent of said flow of atmosphere B extracted is all the lower as this flow is less. In the case of the flow of reagent R being entirely consumed by the processing of the objects P passing through, the flowrate of the fraction of the slow jet 2 injected in the enclosure 4 becomes equal to the induced flowrate at the interface between the slow jet 2 and the atmosphere B that it compensates entirely. The method therefore advantageously enables the consumption of reagent to be limited.

The invention is illustrated by the following example, with reference to FIG. 1.

With the aid of two air curtains, a chamber 4 for continuously sterilizing pharmaceutical products P is confined. Sterilization is obtained by contact of said products P with a sterilizing gas or nebulized liquid ($H_2O_2$) at an optimal temperature. In order to attain and maintain said optimal temperature, two thermostatted slow jets are used. The two air curtains prevent any leakage of $H_2O_2$ towards the adjacent zones (atmosphere A).

The inclination of the points 3 of the slow jets 2 towards the interior of the chamber 4 makes it possible to entrain the contaminating particles which accompany the products P towards the zone of processing by sterilization (atmosphere B), at the inlet and at the exit.

The injection of a part of the air of the slow jet 2 in the chamber 4 generates therein eddying movements which contribute to the homogenization (concentration, temperature) of the sterilizing medium at the centre of said chamber 4.

The effect of depletion of sterilizing reagent in the vicinity of the passage of outflow limits the losses of said reagent and maintains its concentration at the required level for the duration of the processing, optimalizing consumption thereof.

Said method of confinement is carried out under the following conditions:

The chamber 4 is a tunnel of section 0.5×0.5 m. An atmosphere of $H_2O_2$ is maintained therein at 15 g/m$^3$.

The slow jets 2 present the following characteristics:

Initial velocity: $v_o$=0.5 m/s

Flowrate: $Q_o$=0.025 m$^3$/s

They are injected through nozzles 9 presenting a length of 50 cm (length of the opening of the tunnel) and a width (of slit) of 10 cm. The range of the point 3 of said slow jets 2 is 60 cm.

The fast jets 1 present the following characteristics:

Initial velocity: $v_o$=8.17 m/s

Velocity at 0.5 m: v=2 m/s

Initial flowrate: $Q_o$=0.020 m$^3$/s

They are injected through nozzles 10 presenting a length of 50 cm (length of the opening of the tunnel) and a width (of slit) of 5 mm.

At the level of the evacuation conduits 7, the take-up flowrate corresponds to the sum of the flowrate of the fast jet 1, of the slow jet 2, of the supply of sterilizing reagent (variable flowrate), and possibly of the ambient atmosphere (A) sucked (variable flowrate).

We claim:

1. A method for confinement of an atmosphere in a space communicating with the outside by at least one opening by means of a curtain of gas provided at the level of said opening, said method comprising the steps of:

providing a first gas jet, forming a slow jet, having a first side facing said space and a second side, an injection end, a dart of a range L and a spread adapted to cover the entire surface of said opening;

providing a second gas jet, forming a fast jet, having a first side facing the outside, a second side facing said second side of said slow jet, and an injection end, said fast jet having the same direction as said slow jet and an axial plane parallel to that of said slow jet, said fast jet having a flowrate induced by its second side in contact with said slow jet not greater than the flowrate of said slow jet at a distance L corresponding to the range of said slow jet from its injection end;

said slow and fast jets constituting said curtain of gas;

causing at least a part of the gas blown in the form of said slow and fast jets as well as a fraction of the confined atmosphere in said space to be recovered in a zone confronting the injection ends of said slow and fast jets and located at the level of said opening;

injecting a fraction of the flow of the slow jet into the confined atmosphere of the said space thereby inducing an affect on the flowrate of said slow jet; said fraction of said slow jet injected into the said confined atmosphere varying with the pressure within said space.

2. The method of claim 1, further comprising the step of supplying the said space with adequate gas in order to at least compensate said recovered fraction of the confined atmosphere.

3. The method of claim 1, further comprising the step of passing products through the space for allowing processing of the said products in the confined atmosphere.

4. The method of claim 1, wherein the said slow and fast jets are provided to constitute a curtain of gas which is inclined towards the interior of the confined space with respect to the vertical axis of the said opening.

5. The method of claim 1, wherein the said slow and fast jets are provided to constitute a plane curtain of gas.

6. The method of claim 1, wherein the said slow and fast jets are provided to constitute a curtain of gas which describes a surface selected from the group of the cylindrical, truncated and polyhedral surfaces.

7. The method of claim 1, wherein one of said slow jet and fast jet is supplied with thermostatted gas.

8. The method of claim 1, wherein said slow jet and said fast jet are supplied with thermostatted gas.

9. The method of claim 1, wherein the gas provided by said slow jet and the gas provided by said fast jet are at a common temperature.

10. The method of claim 1, wherein said slow jet and said fast jet are air jets and wherein said curtain of gas constitutes a curtain of air.

11. A device for confining an atmosphere in a space communicating with the outside by at least one opening by means of a curtain of gas provided at the level of said opening, said device comprising:

means for discharging a gas curtain which completely confines the said space, said discharge means including first and second nozzle means, said second nozzle means comprising means for discharging a fast gas jet and said first nozzle means comprising means for discharging a slow gas jet between the fast gas jet and the confined space, said two nozzles means been disposed side by side on one side of said opening and provided with means for supplying gas thereto, the length of said nozzle means being at least equal to the length of said opening, the width of said nozzle means being determined as a function of the velocity of fast gas jet and slow gas jet and the range of the curtain to be obtained;

an orifice for suction of at least a part of the gas blown in from said slow and fast jets and a fraction of the confined atmosphere, said orifice confronting said discharge means and being located at the level of said opening;

said gas suction orifice being located with respect to said two nozzle means and presenting a geometry such that a fraction of the flow of the slow jet is injected into said confined atmosphere and contributes to the induced flowrate of said slow jet; said fraction varying with the pressure within said space.

12. The device of claim 11, further comprising a system for supplying the confined space with adequate gas.

13. The device of claim 11, wherein the said two nozzle means are oriented so that the generated gas curtain is inclined towards the interior of the confined space with respect to the vertical axis of the said opening.

* * * * *